US011208998B2

(12) United States Patent
Hosoi et al.

(10) Patent No.: US 11,208,998 B2
(45) Date of Patent: Dec. 28, 2021

(54) ADAPTIVE SELF-SEALING MICROFLUIDIC GEAR PUMP

(71) Applicant: Massachusetts Institute of Technology, Cambridge, MA (US)

(72) Inventors: Anette E. Hosoi, Cambridge, MA (US); Youzhi Liang, Cambridge, MA (US); Irmgard Bischofberger, Somerville, MA (US); Yongbin Sun, Malden, MA (US); Qing Zhang, Cambridge, MA (US); Tianshi Fang, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 159 days.

(21) Appl. No.: 16/454,405

(22) Filed: Jun. 27, 2019

(65) Prior Publication Data

US 2020/0003208 A1 Jan. 2, 2020

Related U.S. Application Data

(60) Provisional application No. 62/691,932, filed on Jun. 29, 2018.

(51) Int. Cl.
*F03C 2/00* (2006.01)
*F03C 4/00* (2006.01)
(Continued)

(52) U.S. Cl.
CPC ..... *F04C 2/18* (2013.01); *F04C 13/001* (2013.01); *F04C 15/0026* (2013.01); *F04C 27/00* (2013.01); *F05C 2251/12* (2013.01)

(58) Field of Classification Search
CPC .. F04C 2/14; F04C 2/18; F04C 13/001; F04C 15/0019; F04C 15/0026; F04C 15/0023;
(Continued)

(56) References Cited

U.S. PATENT DOCUMENTS 2,728,301 A 12/1955 Lindberg
2,842,066 A 7/1958 Hilton
(Continued)

FOREIGN PATENT DOCUMENTS

CN 102420549 A * 4/2012
DE 19825367 12/1999
(Continued)

OTHER PUBLICATIONS

SU-1620680-A1—Balakishee et al.—Gear Pump—Jan. 15, 1991—English Translation (Year: 1991).*
(Continued)

*Primary Examiner* — Theresa Trieu
(74) *Attorney, Agent, or Firm* — Daly, Crowley, Mofford & Durkee, LLP

(57) ABSTRACT

A microfluidic pumping system configured to prevent backflow from an outlet of the system toward an inlet of the system. The microfluidic pumping system comprising a gear housing that has an inlet and an outlet and that houses a drive gear, an idler gear and a drive shaft. The system further includes a front end plate that is coupled to a first surface of the gear housing and a rear end plate that is coupled to a second, different surface of the gear housing. Also coupled to the gear housing is a first and second Halbach magnet arrays that is disposed between the front end plate and the rear end plate. The first and second Halbach magnet arrays include one or more solenoids and the first Halbach magnet array is disposed proximate to the drive gear and the second Halbach magnet array is disposed proximate to the idler gear.

21 Claims, 10 Drawing Sheets

(51) Int. Cl.

| | |
|---|---|
| ***F04C 15/00*** | (2006.01) |
| ***F04C 2/00*** | (2006.01) |
| ***F04C 2/18*** | (2006.01) |
| ***F04C 27/00*** | (2006.01) |
| ***F04C 13/00*** | (2006.01) |

(58) Field of Classification Search
CPC .. F04C 15/0038; F04C 27/00; F04C 2210/42; F05C 2251/12; F02K 5/124; F02K 7/116
See application file for complete search history.

(56) References Cited

U.S. PATENT DOCUMENTS

| | | | | |
|---|---|---|---|---|
| 3,133,506 | A | 5/1964 | Luciani | |
| 4,111,614 | A * | 9/1978 | Martin | F04C 2/14 418/206.1 |
| 4,717,322 | A * | 1/1988 | Masuda | F04C 27/00 418/144 |
| 5,450,305 | A | 9/1995 | Boys et al. | |
| 5,631,618 | A | 5/1997 | Trumper et al. | |
| 6,920,753 | B2 | 7/2005 | Namuduri | |
| 8,264,314 | B2 | 9/2012 | Sankar | |
| 2003/0235504 | A1 | 12/2003 | Lemoff et al. | |
| 2006/0088427 | A1 * | 4/2006 | Hirano | F04C 2/14 418/206.1 |
| 2006/0140810 | A1 * | 6/2006 | Kameya | F04C 2/084 418/171 |
| 2007/0071616 | A1 | 3/2007 | Owen et al. | |
| 2007/0237658 | A1 | 10/2007 | Burns et al. | |
| 2011/0268598 | A1 * | 11/2011 | Paval | F04C 15/0096 418/83 |
| 2013/0019827 | A1 * | 1/2013 | Oka | F01L 1/34 123/90.17 |
| 2015/0018168 | A1 | 1/2015 | Davey et al. | |
| 2016/0102529 | A1 * | 4/2016 | DiSantis | E21B 41/0085 166/65.1 |

FOREIGN PATENT DOCUMENTS

| | | | | |
|---|---|---|---|---|
| JP | 2010121614 | A * | 6/2010 | F01L 1/34 |
| JP | 4806777 | | 11/2011 | |
| SU | 1620680 | A1 * | 1/1991 | |

OTHER PUBLICATIONS

CN-102420549-A—Zhang et al.—Magnetic Gear and Magnetic Transmission Device—Apr. 18, 2012—English Translation—(Year: 2012).*

International Preliminary Report on Patentability dated Jan. 7, 2021 for International Application No. PCT/US2019/039381; 9 Pages.

Search Report and Written Opinion dated Sep. 19, 2019 for PCT Application No. PCT/US2019/039381, 24 pages.

* cited by examiner

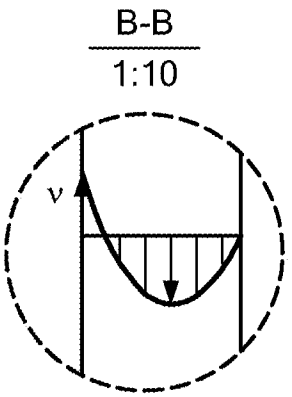
FIG. 6C
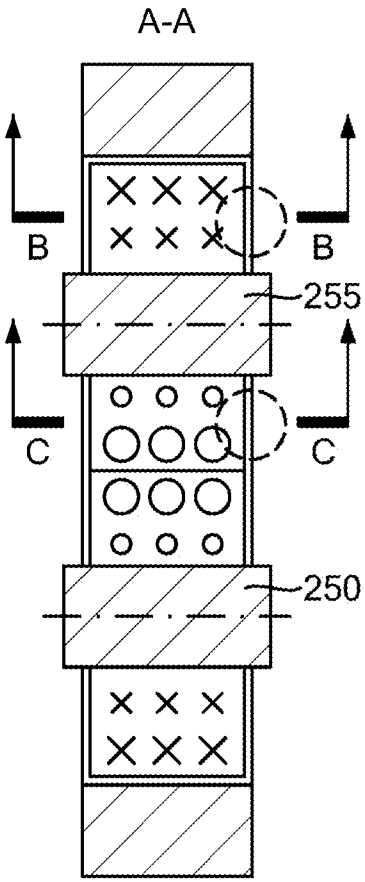
FIG. 6D
Side view of an external gear pump
FIG. 6B
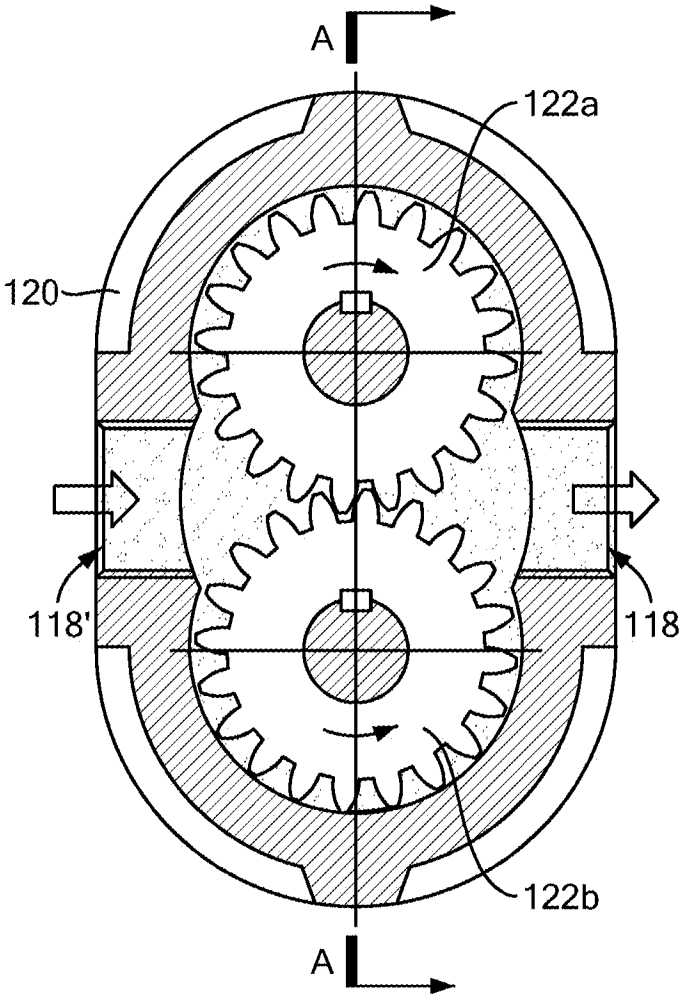
Front view of an external gear pump
FIG. 6A Schematic of a shaft and a housing Traditional sealing Dynamic sealing using MR fluids

ADAPTIVE SELF-SEALING MICROFLUIDIC GEAR PUMP

RELATED APPLICATIONS

This application claims priority to and benefit of U.S. Provisional Application No. 62/691,932, filed Jun. 29, 2018. The entire teaching of this provisional application is incorporated herein by reference in its entirety.

GOVERNMENT RIGHTS

This invention was made with Government support under Grant No. W31P4Q-13-1-0013 awarded by the Army Contracting Command. The Government has certain rights in the invention.

BACKGROUND

Microfluidic systems or processes effectuate movement of fluids through micro or nanoscale structures. There are a variety of applications that use microfluidics including chemical analyses, biological sample analyses, assay execution, biological sensing and micro-robots. In these applications, fluid flows through a series of micro or nanoscale structures to carry out a reaction, distribute an analyte or reagent, mix compounds, increase the temperature of a sample, position a sample for analysis, or otherwise move a compound, sample, gas or other liquid mixture from one point in a system to another. Movement of a liquid or gas through a microfluidic system requires imparting a mechanical, electrical or chemical force to the fluid or gas to generate fluid flow. This force can be a mechanical force imparted by a micropump, which is a micro or nanoscale pumping structure used in a microfluidic system. Micropumps can further be used to facilitate or control fluid movement within the microfluidic system.

Mechanical micropumps are often an inefficient means for providing a pressure to fluid in a microfluidic system because of their low efficiency as compared to their macroscale counterparts. This low efficiency can be due in part to volumetric loss within the micropumps, such as between the tips of gears and the housing. Illustrated in FIG. 1 is a graphical depiction 300 of the various efficiencies of known micropump technologies plotted against a maximum pressure for the listed micropumps. The size of the symbols in FIG. 1 correspond to a scale that represents the typical length scale of the pump package in the microfluidic system described by each reference. The location of the center of each circle depicts the efficiency of the pump package as a function of pressure. For example, Sim 330 demonstrates a mechanical pump that has an efficiency of 72 $mm^3$ per unit length for that system. Kargov et al. 340, 350 also demonstrates a mechanical pump and has an efficiency of 18.5 $cm^3$ per unit length for that system. As illustrated in FIG. 1, of the known micropumps, the most efficient means for pumping in a microfluidic system are means for pumping using a thermal, bubble-actuated pump.

Shown in FIG. 1 is the efficiency for the mechanical micropump with flap valves 330 described in Woo Young Sim, Hyeun Joong Yoon, Ok Chan Jeong, and Sang Sik Yang, *A phase-change type micropump with aluminum flap valves*, Journal of Micromechanics and Microengineering, 13(2):286, 2003 ("Sim"). Also shown is the efficiency for an electroosmotic pump 310 described in Shuhuai Yao, David E. Hertzog, Shulin Zeng, James C. Mikkelsen and Juan G. Santiago, *Porous glass electroosmotic pumps: design and experiments*, Journal of Colloid and Interference Science, 268(1): 143-153, 2003 ("Yao"). Also shown is the efficiency for a gear pump 350 described in A. Kargov, T. Werner, C. Pylatiuk and S. Schulz, *Development of a miniaturised hydraulic actuation system for artificial hands*, Sensors and Actuators A: Physical, 141 (2): 548-557, 2008 ("Kargov"). Also shown is the efficiency for a surface-tension driven pump 320 described in Kwang-Seok Yun, Il-Joo Cho, Jong-Uk Bu, Chang-Jin Kim and Euisik Yoon, *A surface-tension driven micropump for low-voltage and low-power operations*, Journal of microelectromechanical systems, 11(5): 454-461, 2002 ("Yun"). Also shown is the efficiency for an electrohydrodynamic pump 340 described in A. Richter, A. Plettner, K. A. Hofmann and H. Sandmaier, *Sensors and Actuators A: Physical,* 29(2):159-168, 1991 ("Richter"). Also shown is the efficiency for a pneumatic chamber pump 335 described in R. Rapp, W. K. Schomburg, D. Maas, J. Schulz and W. Stark, Liga micropump for gases and liquids, Sensor and Actuators A: Physical 40(1):57-61, 1994 ("Schomburg"). Also shown is the efficiency for an electromagnetic pump 360 described in M. Shen, C. Ymahata and MAM Gijs, *A high performance compact electromagnetic actuator for a pmma ball-valve micropump*, Journal of Micromechanics and Microengineering, 18(2):025031, 2008 ("Shen"). Also shown is the efficiency for a thermopneumatic pump 345 as described in F C M Van de Pol, H T G Van Lintel, M. Elwenspoek and J H J Fluitman, *A thermopneumatic micropump based on micro-engineering techniques*, Sensors and Actuators A: Physical, 21(1):198-202, 1990 ("Van de Pol"). Also shown is the efficiency for a thermal-bubble actuated pump 355 as described in Jr-Hung Tsai and Liwei Lin, *A thermal-bubble-actuated micronozzle-diffuser pump*, Journal of microelectromechanical systems, 11(6):665-671, 2002 ("Tsai"). Also shown is the efficiency for an electromagnetic pump 375 as described in Ki Hoon Kim, Hyeun Joong Yoon, Ok Chan Jeong and Sang Sik Yang, *Fabrication and test of a micro electromagnetic actuator*, Sensors and Actuators A: Physical 117(1):8-16, 2005 ("Kim"). Also shown is the efficiency for an electrokinetic pump 370 as described in David S. Reichmuth, Gabriela S. Chirica and Brian J. Kirby, *Increasing the performance of high-pressure, high-efficiency electrokinetic micropumps using zwitterionic solute additives*, Sensors and Actuators B: Chemical 92(1):37-43, 2003 ("Reichmuth"). Also shown is the efficiency for an electrostatic pump 365 as described in R. Zengerle, J. Ulrich, S. Kluge, M. Richter and A. Richter, *A bidirectional silicon micropump*, Sensors and Actuators A: Physical, 50(1):81-86, 1995 ("Zengerle"). Also shown is the efficiency for a thermopneumatic pump 325 as described in Xing Yang, Charles Grosjean and Yu-Chong Tai, *Design, Fabrication and testing of micromachined silicone rubber membrane valves*, Journal of microelectromechanical systems, 8(4):393-402, 1999 ("Grosjean").

Typically, the overall efficiency of a micropump can be determined by a combination of four efficiency components: volumetric efficiency, hydraulic efficiency, mechanical efficiency and electrical efficiency. Out of these four efficiency components, lowered efficiency due to volumetric losses and hydraulic losses are most apparent and detrimental at micro and nano-sized scales such as the small scales characteristic of micropumps and nanopumps. As the size of the microfluidic system decreases, the volumetric efficiency decreases. This is because the same dimensional and geometric tolerances specific to macro-fluidic systems result in a larger fractional loss in a microfluidic system. Furthermore, in terms of hydraulic efficiency, the Reynolds number decreases as the systems size decreases, resulting in larger viscous losses.

When external gear pumps are used in conjunction with microfluidic systems, the volumetric losses are roughly proportional to the pressure gradient assuming a quasi-steady fully developed low Reynolds number (such as the wet paint on a wall, where the wet paint driven by gravity) across the clearance between the housing and the gear tips. Thus, the efficiency of an external gear pump may be extremely low, such as $10^{-6}$, when the pump is operating under high pressure gradient conditions, such as at pressures as large as 100 kPa. The volumetric leakage between the tips of the gears and across the side plates of an external gear pump is typically considered to comprise the largest proportion of the total efficiency loss in external gear pumps, while volumetric leakage which occurs between the tip of the gear teeth and the housing is relatively small in comparison to the volumetric leakage between the tips of the gears and across the side plates. Various end wear plates have been designed and implemented to reduce the leakage across the side plates, however, available systems continue to experience volumetric losses due to such leakage.

Sealing aspects of a micropump can be challenging because of the limits of manufacturing precision available using known manufacturing techniques. Precise manufacturing techniques and tight tolerances (i.e. specifying that mechanical parts be fabricated to specific dimensions within a specified tolerance) could be employed during the manufacturing of micropumps to reduce volumetric loss and increase efficiency of the micropump. This gain in efficiency, however, would be achieved at the expense of an increase in an amount of mechanical friction between the housing and the gears of the micropump and an increase in the micropump's vulnerability to vibrations as well as an increase in the cost to manufacture such tightly tolerance parts.

To reduce the volumetric losses experienced with current micropumps while avoiding an increase in mechanical friction and vibrational vulnerability, a high efficiency micropump with a high volumetric accuracy and able to interface with current mechanical architectures and manufacturing tolerances is needed.

SUMMARY

In accordance with the concepts, systems, devices and techniques described herein, it has been found that magneto-rheological (MR) fluids that can operate with existing mechanical micropump architectures and within existing manufacturing tolerances, can be used to reduce volumetric losses cause by current micropump architectures. MR fluids can be used in systems and apparatuses configured to statically or dynamically seal aspects of a micropump. The efficiency and/or performance of the MR fluids can be characterized and evaluated using two Mason numbers Mn (p) and Mn (Ω) which are defined in terms of the pressure gradient of the flow and velocity of the moving boundary respectively. The effectiveness of the MR fluids at sealing the micropump can be evaluated using the ratio of volumetric loss and friction factor, while the effectiveness of this dynamic sealing method under different working conditions for gear pumps can be quantified.

Illustrated herein is an embodiment of a micro-fluidic pumping system which includes a gear housing having an inlet and an outlet, and a drive gear, an idler gear and a drive shaft that are disposed within the gear housing. Disposed within the housing is a magneto-rheological (MR) fluid. The pumping system includes a front end plate coupled to a first surface of the gear housing, and a rear end plate coupled to a second, different surface of the gear housing. Also included within the gear housing are first and second Halbach magnet arrays that are coupled to the gear housing and disposed between the front end plate and the rear end plate. The Halbach magnet arrays include one or more solenoids and the first Halbach magnet array is disposed proximate to the drive gear and the second Halbach magnet array is disposed proximate to the idler gear.

In some embodiments, the gear housing is disposed between the front end plate and the rear end plate. In other embodiments, the first Halbach magnet array is disposed on an upper surface of the gear housing and the second Halbach magnet array is disposed on a lower surface of the gear housing.

In still other embodiments, a clearance between the drive gear and the idler gear forms a channel coupling the inlet to the outlet. A flowrate of the magneto-rheological (MR) fluid through this channel corresponds to dimensions of at least one of or a combination of: the gear housing, the drive gear, the idler gear, a rotational speed of the drive gear, a rotational speed of the idler gear, or a magnetic field intensity of the first and second Halbach magnet arrays. A back flow rate of this channel corresponds to dimensions of at least one of or a combination of: the gear housing, the drive gear, the idler gear, a rotational speed of the drive gear, a rotational speed of the idler gear, or a magnetic field intensity of the first and second Halbach magnet arrays.

The gear housing, the front end plate and the rear end plate can include non-ferromagnetic material. In some instances, the upper surface and the lower surface of the gear housing have an arc shape adjoining two flat surfaces.

The first and second Halbach magnet arrays can comprise a top Halbach array scaffold, a bottom Halbach array scaffold, five ferromagnetic blocks, a plurality of wires and two independent resonant-power-transfer supplies. In some embodiments, each of the five ferromagnetic blocks can have a ring shape with a rectangular cross-section with a direction of one or more sides orthogonal to a radial direction. Each of the five ferromagnetic blocks can comprise ferromagnetic material or have a counter-bored hole. The plurality of wires can be routed on the five ferromagnetic blocks and the bottom Halbach scaffold.

In some embodiments, the system can include one or more microchannels that can have a width less than 500 nm.

Also described herein is a micro-fluidic pumping system that includes a gear housing that has an inlet and an outlet, a drive gear, an idler gear and a drive shaft. Disposed within the gear housing is a magneto-rheological (MR) fluid. A front end plate can be coupled to a first surface of the gear housing, and a rear end plate coupled to a second, different surface of the gear housing. First and second Halbach magnet arrays can be coupled to the gear housing and disposed between the front end plate and the rear end plate. The first and second Halbach magnet arrays can include one or more solenoids, and the first Halbach magnet array can be disposed proximate to the drive gear and the second Halbach magnet array can be disposed proximate to the idler gear. The first and second Halbach magnet arrays can generate a magnetic field that causes the MR fluid to create dipoles within a gap between the gear housing, the drive gear or the idler gear.

The magnetic field can cause the MR fluid to create dipoles within a gap between the gear housing and the drive gear, and a second gap between the gear housing and the idler gear. In other embodiments, the magnetic field can cause the MR fluid to create dipoles within a gap between the gear housing and the front end plate.

BRIEF DESCRIPTION OF THE DRAWINGS

The foregoing features may be more fully understood from the following description of the drawings in which:

FIG. 6A is a top (or front) view of a portion of an external gear pump.

FIG. 6B is a cross-sectional view taken along lines A=A of the portion of the external gear pump shown in FIG. 6A.

FIG. 6C is an enlarged view of a portion of the external gear pump illustrated in FIG. 6A taken along lines B-B in FIG. 6B.

FIG. 6D is an enlarged view of a portion of the external gear pump illustrated in FIG. 6A taken along lines C-C in FIG. 6B. sealing between FIG. 7A is an isometric view of a portion of a shaft and housing of an external gear pump.

DETAILED DESCRIPTION

Figure 1:
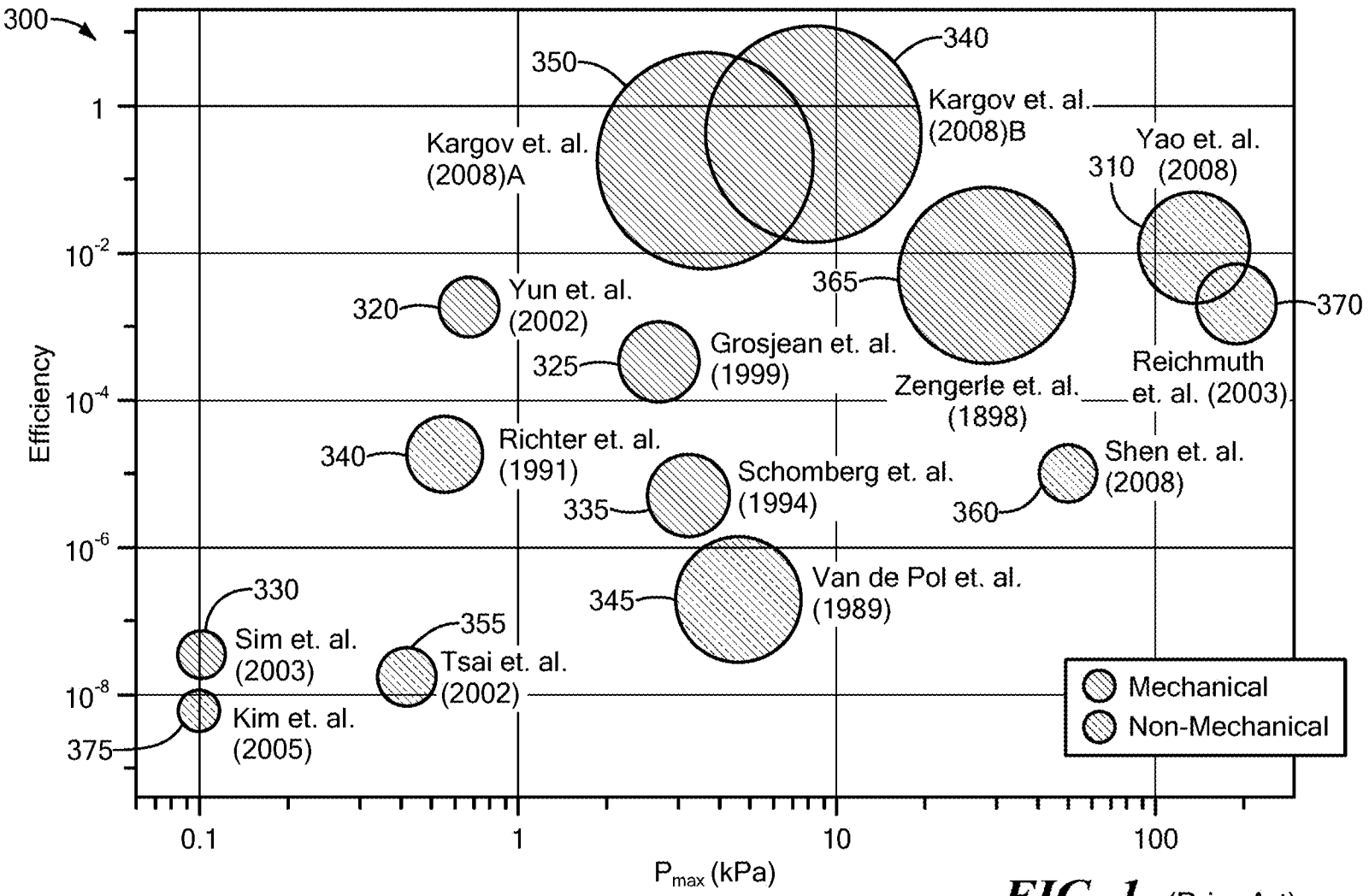
FIG. 1 (Prior Art)
FIG. 1 is a plot of efficiency vs. pressure which illustrates a prior art graphical depiction of a measure of efficiency versus maximum pressure for conventional small-scale pumping strategies.

Various embodiments of the concepts systems and techniques are described herein with reference to the related drawings. Alternative embodiments can be devised without departing from the scope of the described concepts. It is noted that various connections and positional relationships (e.g., over, below, adjacent, etc.) are set forth between elements in the following description and in the drawings. These connections and/or positional relationships, unless specified otherwise, can be direct or indirect, and the present disclosure is not intended to be limiting in this respect. Accordingly, a coupling of entities can refer to either a direct or an indirect coupling, and a positional relationship between entities can be a direct or indirect positional relationship. As an example of an indirect positional relationship, references in the present description to element or structure "A" over element or structure "B" include situations in which one or more intermediate elements or structures (e.g., element "C") is between element "A" and element "B" regardless of whether the characteristics and functionalities of element "A" and element "B" are substantially changed by the intermediate element(s).

Additionally, the term "exemplary" is used herein to mean "serving as an example, instance, or illustration." Any embodiment or design described herein as "exemplary" is not necessarily to be construed as preferred or advantageous over other embodiments or designs. The terms "one or more" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

References in the specification to "one embodiment," "an embodiment," "an example embodiment," or variants of such phrases indicate that the embodiment described can include particular features, structures, or characteristics, but every embodiment can include the particular feature, structure, or characteristic. Moreover, such phrases are not necessarily referring to the same embodiment. Further, when a particular feature, structure, or characteristic is described in connection knowledge of one skilled in the art to affect such feature, structure, or characteristic in connection with other embodiments whether or not explicitly described.

Furthermore, it should be appreciated that relative, directional or reference terms (e.g. such as "above," "below," "left," "right," "top," "bottom," "vertical," "horizontal," "front," "back," "rearward," "forward," etc.) and derivatives thereof are used only to promote clarity in the description of the figures. Such terms are not intended as, and should not be construed as, limiting. Such terms may simply be used to facilitate discussion of the drawings and may be used, where applicable, to promote clarity of description when dealing with relative relationships, particularly with respect to the illustrated embodiments. Such terms are not, however, intended to imply absolute relationships, positions, and/or orientations. For example, with respect to an object or structure, an "upper" surface can become a "lower" surface simply by turning the object over. Nevertheless, it is still the same surface and the object remains the same. Also, as used herein, "and/or" means "and" or "or", as well as "and" and "or." Moreover, all patent and non-patent literature cited herein is hereby incorporated by references in its entirety for all purposes.

The terms "disposed over," "overlying," "atop," "on top," "positioned on" or "positioned atop" mean that a first element, such as a first structure, is present on a second element, such as a second structure, where intervening elements or structures (such as an interface structure) may or may not be present between the first element and the second element. The term "direct contact" means that a first element, such as a first structure, and a second element, such as a second structure, are connected without any intermediary elements or structures between the interface of the two elements.

As used herein, the term "fluid" may be used to refer to a liquid, a liquid comprising solid matter, a gas or any other material that deforms when shear stress is applied thereto.

The term "fluid dynamic" may be used to refer to characteristics or properties of a fluid flow (i.e. the flow of a fluid), for example fluid dynamic can refer to the velocity, direction or pressure at which a fluid flows, or the temperature or density of a fluid.

The term "magnetorheological (MR) fluids" refers to materials that exhibit a reversible change in rheological properties with the application of an external magnetic field, which can result in a rich range of physical properties. Typical operational modes for MR fluid application are the pressure driven flow mode and the direct shear mode.

Figure 2B:
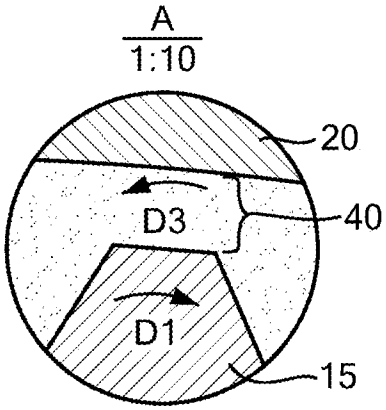
FIGS. 2B-2C are magnified (or enlarged) views of a portion of the external gear pump illustrated in FIG. 2A.
Figure 2C:
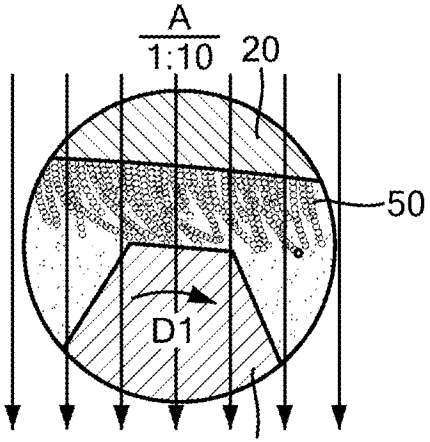
Figure 2A:
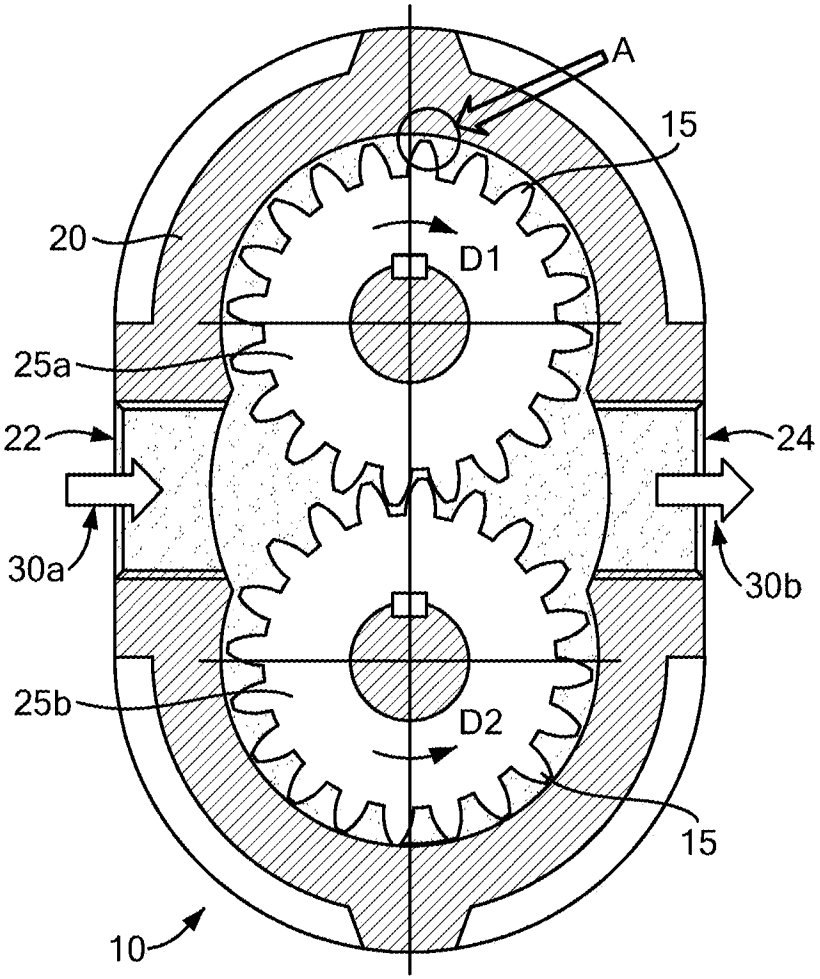
FIG. 2A is a cross-sectional view of a portion of an external gear pump.

Illustrated in FIG. 2A is an external gear pump 10 having two gears 25*a-b* with gear teeth 15. The first gear 25*a* turns in a first direction D1, while the second gear 25*b* turns in a second direction D2. The gears 25*a-b* are housed in a housing 20 with an inlet 22 and an outlet 24. An area of the external gear pump 10 during operation is circled in FIG. 2A and labeled "A", FIGS. 2B and 2C illustrate a magnified portion of this area "A".

Fluid flows through the inlet 22 of the housing with a first fluid dynamic 30*a* and out of the outlet 24 of the housing 20 with a second fluid dynamic 30*b*. In some embodiments the first fluid dynamic 30*a* can be substantially equal to the second fluid dynamic 30*b*, while in other embodiments, the two dynamics 30*a-b* can differ from each other. For example, the fluid can flow through the inlet 22 with a first fluid dynamic 30*a* having a first velocity, however the fluid can flow out of the outlet 24 with a second fluid dynamic 30*b* having a second different velocity.

In this example, the velocity of the second fluid dynamic 30*b* can be higher or lower depending on the rotational speed of the gears 25*a-b*. In another example, the fluid can flow into the inlet 22 with a first fluid dynamic 30*a* that has a first pressure, and out of the outlet 24 with a second fluid dynamic 30*b* that a second pressure that is larger than the first pressure. When fluid dynamic 30*b* at the outlet has a higher pressure than the fluid dynamic 30*a* at the inlet 22, fluid can flow in an opposite direction to the first and second fluid dynamic 30*a-b*, otherwise referred to as backflow. In this example, the backflow is a Poiseuille flow caused by the pressure gradient created between the difference in pressure of the fluid dynamic 30*a* at the inlet 22 and the fluid dynamic 30*b* at the outlet 24. While backflow can be a Poiseuille flow cause by a pressure differential, it can also be a Poiseuille flow caused by a high shear stress caused by a large exerted force.

FIG. 2B illustrates a magnified view of a portion (i.e., the portion of FIG. 2A circled and labeled "A") of the external gear pump 10 during operation and when the pressure of the fluid at the inlet 22 is less than the pressure of the fluid at the outlet 24. The difference in pressure between the first and second fluid dynamic 30*a-b* can cause backflow across a gap 40 between a surface of housing 20 and a surface of gear tooth 15. To promote clarity and conciseness in the description and drawings, this is illustrated for a single gear tooth, however backflow may occur in a gap between a surface of the housing and a surface of any gear tooth. This backflow can be characterized as having a direction D3 that is opposite to the direction of movement of the gear 25*a*, i.e. D1. Fluid that backflows across the gap 40 can have a third fluid dynamic with its own flow velocity, pressure and direction. This third fluid dynamic can differ from the fluid dynamic 30*a* at the inlet 22 and the fluid dynamic 30*b* at the outlet 24. Flow through the gap 40 can be characterized as Couette flow which is a laminar, circular flow of fluid between a static surface and a rotating surface. In this instance, the Couette flow of the fluid through the gap 40 flows between a static surface (e.g. a surface of the static housing 20) and a surface that rotates relative to the static surface (e.g. a surface of the movable gear tooth 15).

FIG. 2C is an enlarged (or magnified) view of a portion (i.e., the portion of FIG. 2A circled and labeled "A") of the external gear pump 10 during operation and while using MR fluid that has a fluid dynamic 50 generated by applying an external magnetic field 45 to the MR fluid. In the illustrative embodiment of FIG. 2C, applying the magnetic field 45 to the MR fluid causes magnetically induced dipoles to aggregate in the vicinity of the housing 20 and specifically in the gap 40. The existence of the magnetic dipoles in the gap 40 prevents backflow of the MR fluid. That is, the characteristics of the MR fluid are such that the MR fluid will not flow in a direction opposite the movement of the gear (e.g. gear 25*a*) in the presence of the magnetic dipole. Thus, using the MR fluid and applying an external magnetic field 45 controls flow of fluid through aspects of the external gear pump 10 without requiring modified manufacturing methods.

Further referring to FIG. 2C and in more detail, the MR fluid can be any MR fluid, or in some instances be a commercially available MR fluid such as those manufactured by the LORD corporation, e.g. LORD MRF-140CG Magneto-Rheological Fluid. Other MR fluids may, of course, also be used. In particular, the MR fluid can be a homogeneous or non-homogeneous mixture of fluid or medium with MR particles suspended therein. The volume fraction of MR particles within the MR fluid can be within a range of 1% to 10%. When a magnetic field is applied to a microfluidic system with a micropump and the flow velocity or flow rate through a portion of a micropump is lower than a predetermined threshold, the MR particles within the MR fluid can form dipole chains that aggregate in bunches. When a magnetic field is applied to a microfluidic system with a micropump and the flow velocity or flow rate through a portion of a micropump is lower than a predetermined threshold, the dipole chains of MR particles begin to deform and eventually collapse.

Figure 3A:
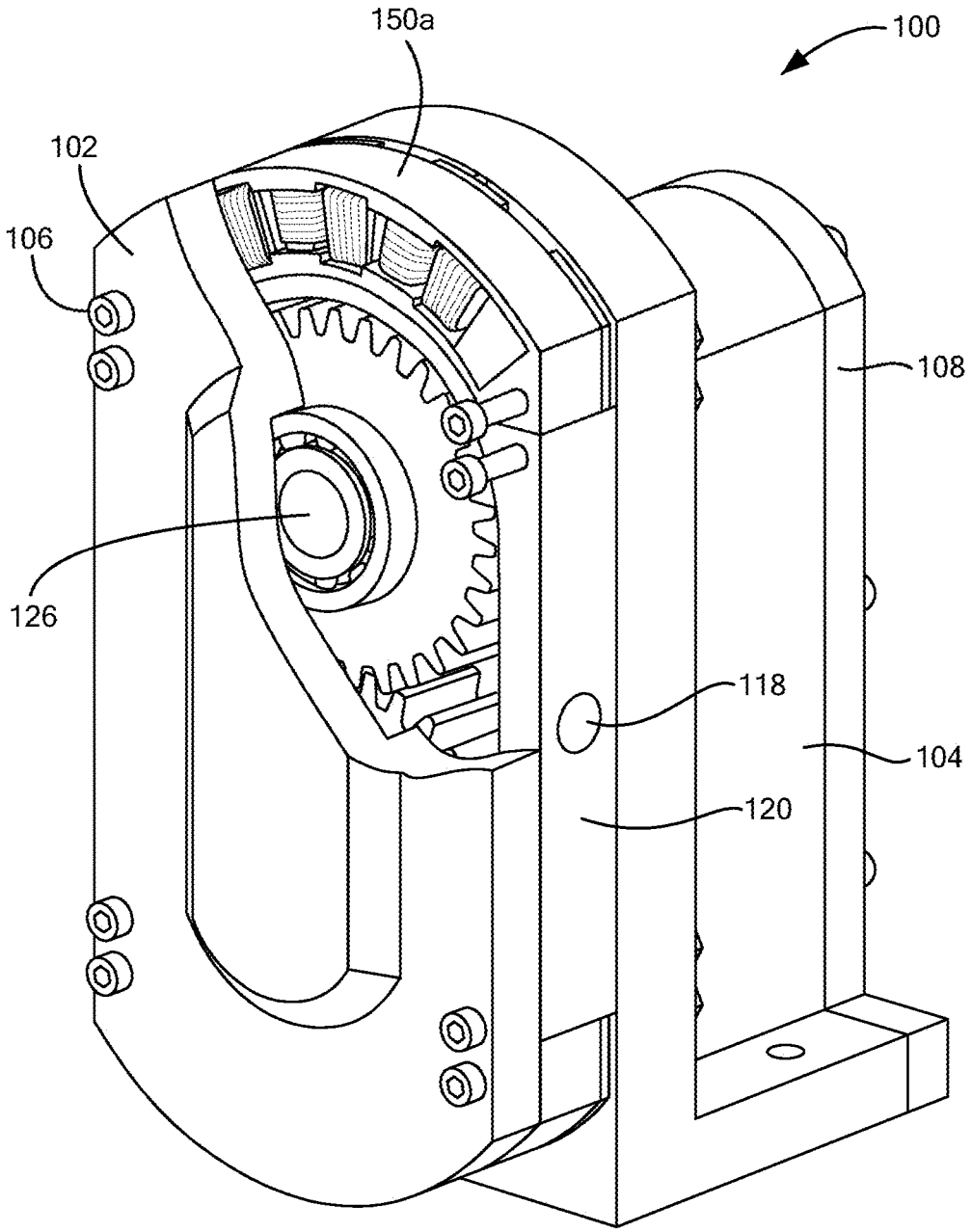
FIG. 3A is an isometric view of an adaptive microfluidic system having portions thereof removed to reveal a portion of a gear.

Illustrated in FIG. 3A is a microfluidic system 100 that uses a sealed micropump. Aspects of the microfluidic system 100 are further demonstrated in the exploded view of FIG. 3A illustrated in FIG. 3B. The microfluidic system 100 includes a front end plate 102 mechanically coupled to a gear housing 120 and a rear end plate 104 using on or more mechanical fasteners 106. Coupling the front end plate 102 to the gear housing 120 encloses one or more gears 122*a-b* within the gear housing 120. Each gear 122*a-b* has one or more gear teeth 124. At least one gear 122*a* rotates about a drive shaft 126 that extends through the gear housing 120, the rear end plate 104 and mechanically couples to a rear housing 108 with a drive shaft support 112 that at least partially supports the drive shaft 126. Included within the gear housing 120 is a pressure port 118 and disposed on either end of the gear housing are solenoid arrays 150*a-b*.

Figure 3B:
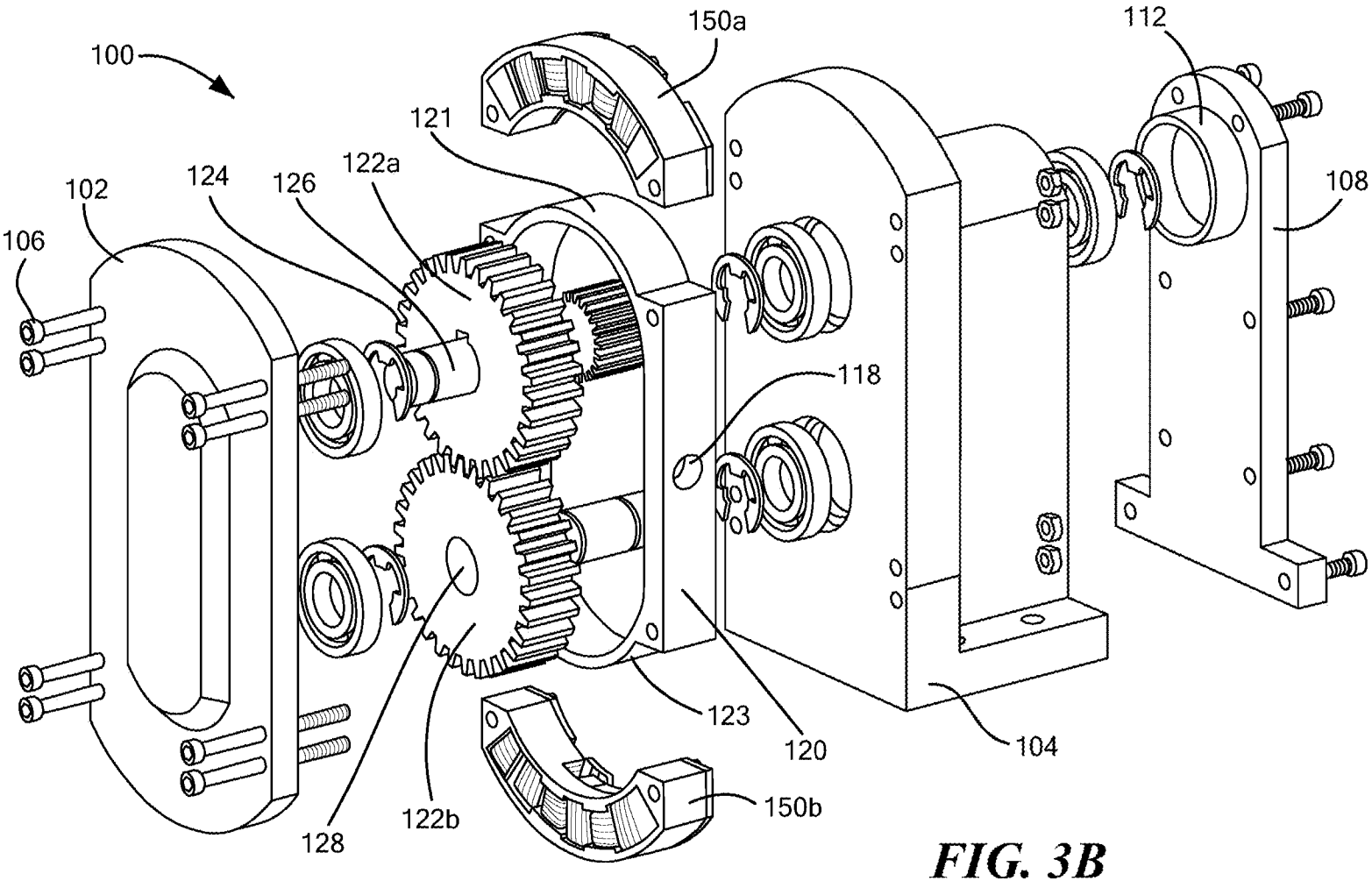
FIG. 3B is an exploded view of the adaptive microfluidic system of FIG. 3A.

Further referring to FIGS. 3A and 3B, and in more detail, the front end plate 102 can be mechanically coupled to the gear housing 120 via one or more fasteners 106. These fasteners can be screws, nails, pegs or any other type of mechanical fastening means. In some embodiments, the front end plate 102 can be coupled to the gear housing 120 via an adhesive, while in other embodiments the front end plate 102 can be permanently fastened to the gear housing 120.

The gears 122*a-b* can function similarly to the gears 25*a-b* illustrated in FIGS. 2A-2C.

Each gear 122*a-b* can have a plurality of gear teeth 124. A first gear 122*a* can be a drive gear 122*a* mounted on a drive shaft 126 such that the drive gear 122*a* can rotate about the drive shaft 126. A second drive gear 122*b* can be an idler gear 122*b* that rotates about a fixed shaft 128. The gear teeth 124 of the drive gear 122*a* can engage the gear teeth 124 of the idler gear 122*b* to rotate the idler gear 122*b* in a direction opposite of the direction of movement of the drive gear 122*a*. For example, when the drive shaft 126 rotates the drive gear 122*a* in a clockwise direction, the gear teeth 124 of the drive gear 122*a* engage the gear teeth 124 of the idler gear 122*b* to rotate the idler gear 122*b* in a counterclockwise direction. These directions can correspond to the directions illustrated in FIG. 2A such that the drive gear 122*a* (25*a* in FIG. 2A) moves in a clockwise direction (D1 in FIG. 2A) which causes the idler gear 122*b* (25*b* in FIG. 2A) to move in a counter-clockwise direction (D2 in FIG. 2A).

The drive shaft 126 controls movement of the drive gear 122*a* which in turn controls movement of the idler gear 122*b*. Thus, the drive shaft 126 controls the rotational speed of the drive gear 122*a* and in turn the rotational speed of the idler gear 122*b*. In some embodiments, the drive shaft 126 can be movably manipulated and controlled by a motor (not shown).

Included within the gear housing 120 is a pressure port 118 which can include a hole bored through the surface of the gear housing 120. An identical port, a suction port 118' (not shown), can be located on the opposite surface of the gear housing 120. The suction port 118' can be an inlet such as the previously discussed inlet (22 in FIG. 2A) that has a first fluid dynamic (30*a* in FIG. 2A), and the pressure port 118 can be an outlet such as the previously discussed outlet (24 in FIG. 2A) that has a second fluid dynamic (30*b* in FIG. 2A). In an embodiment, the sealed micropump of the microfluidic system 10 can be used to pump magneto-rheological (MR) fluid from the suction port 118' to the pressure port 118 by applying a rotational speed to the gears 122*a-b* via the drive shaft 126.

Disposed between the front end plate 102 and the rear end plate 104 and located on either end of the gear housing 120 are two solenoid arrays 150*a-b*. These solenoid arrays 150*a-b* can include a Halbach magnet array of solenoids. In some embodiments, each Halbach magnet array 150*a-b* can be attached to either end of the gear housing 120 such that one Halbach magnet array 150*a* is attached to the top of the gear housing 120 or proximate to the drive gear 122*a*, while the second Halbach magnet array 150*b* is attached to the bottom of the gear housing 120 or proximate to the idler gear 122*b*. The first Halbach magnet array 150*a* may be disposed on an upper surface 121 of the gear housing and the second Halbach magnet array 150*b* may be disposed on a lower surface 123 of the gear housing.

The Halbach magnet arrays 150*a-b* can be powered by one or more power supplies (not shown) that supply a current and/or potential to the Halbach magnet arrays 150*a-b* to cause each array to generate a magnetic field. These power supplies (not shown) can be charged using resonant power transfer. In response to receiving current and/or potential from the external power supplies, the Halbach magnet arrays 150*a-b* generate a magnetic field having a direction perpendicular to a direction of backflow. The direction of the generated magnetic field can be substantially similar to the direction of the magnetic field illustrated in FIG. 2A (45 in FIG. 2A). Just as the external magnetic field 45 illustrated in FIG. 2A caused the MR fluid particles to aggregate in the vicinity of the gear teeth or more specifically the gap 40, and reduce the backflow, when the Halbach magnet arrays 150*a-b* generate the magnetic field across the clearance (i.e. the gap 40 illustrated in FIG. 2B) formed between the gear housing 120 and the gear teeth 124, the magnetic particles in the magneto-rheological (MR) fluid aggregate to adjust and prevent the back-flow driven by the pressure gradient between the suction port 118' and the pressure port 118. The power source or supplies (not shown) can control the magnetic field intensity of the magnetic field generated by the Halbach magnet arrays 150*a-b* by controlling an amount of current applied to the arrays 150*a-b*.

Figure 4A:
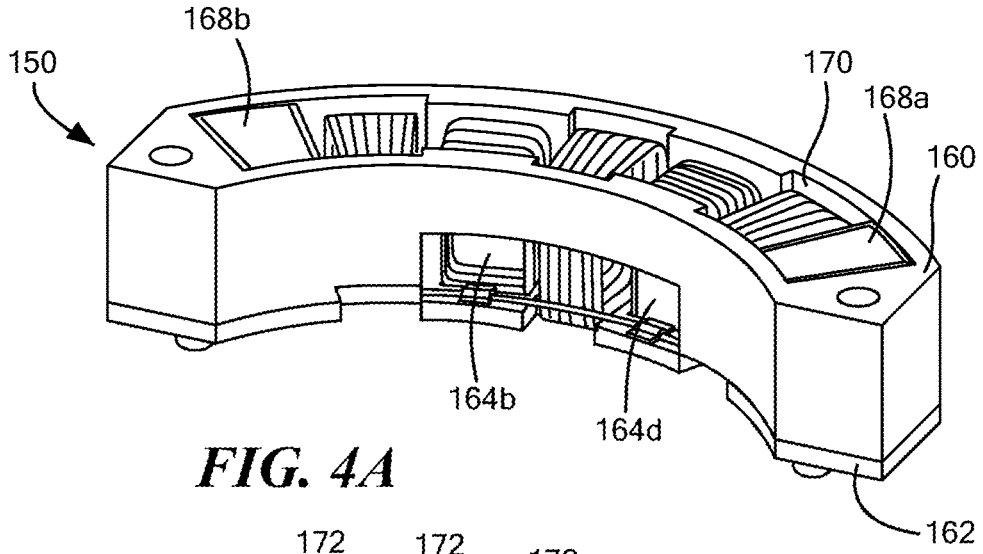
FIG. 4A is an isometric view of an array of solenoids arranged in a Halbach configuration to provide a magnet array.
Figure 4B:
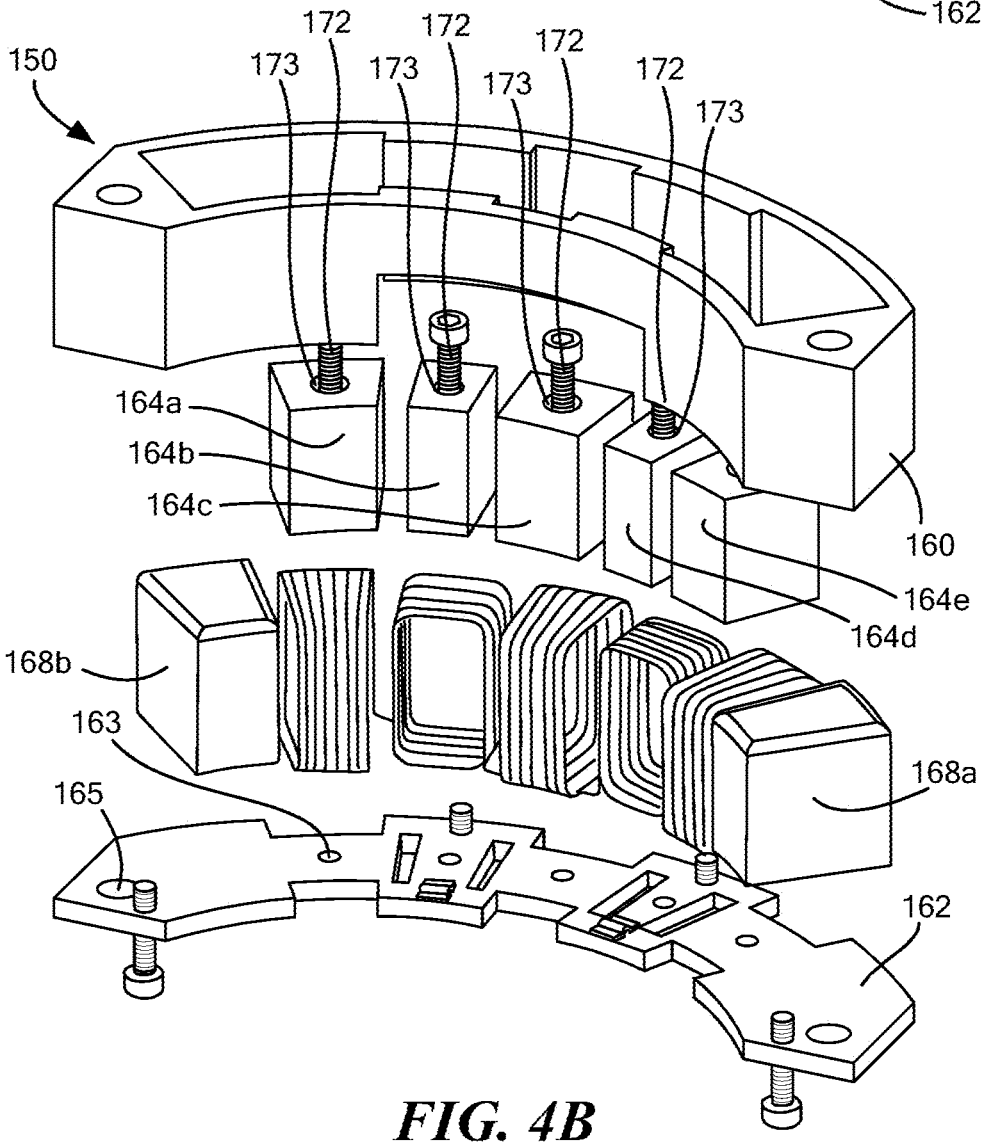
FIG. 4B is an exploded view of the Halbach array of solenoids of FIG. 4A

Illustrated in FIG. 4A is a Halbach magnet array of solenoids 150 and illustrated in FIG. 4B is an exploded view of the Halbach magnet array of solenoids 150 of FIG. 4A. While FIGS. 4A-4B illustrate a single Halbach magnet array 150, it should be understood that as shown in FIGS. 3A-3B, more than one Halbach magnet array 150 can be included in a micropump of a microfluidic system 100. The Halbach magnet array of solenoids 150 includes a top Halbach array scaffold 160, a bottom Halbach array scaffold 162, five ferromagnetic blocks 164*a-e*, routed wires 170, two independent resonant-power-transfer supplies 168*a-b*, and mounting screws 172. Each block 164*a-e* is a section of a ring with a rectangular cross-section, and each block 164*a-e* has a counter-bored hole 173 for mounting on the bottom scaffold 162 with screws 172. The wires 170 are routed in the way which can generate magnetic field illustrated in FIG. 5, and after the ferromagnetic blocks 164*a-e* are mounted on the bottom scaffold 162.

In one embodiment, the bottom scaffold 162 has nine threaded holes 163 used to mount the ferromagnetic blocks 164*a-e* with screws 172, the resonant-power-transfer supply 168*a-b*, and the top Halbach array scaffold 160 respectively. The bottom scaffold 162 also has two unthreaded holes 165 (which may also be referred to as through-holes) used for screws to secure the front end plate 102, Halbach magnet array of solenoids 150 and rear end plate 104. In an embodiment, the two independent power supplies 168*a-b* power the Halbach array of solenoids 150 alternately, and charge via the two resonant-power-transfer supplies 168*a-b* alternately and during a vacant period.

Figure 5:
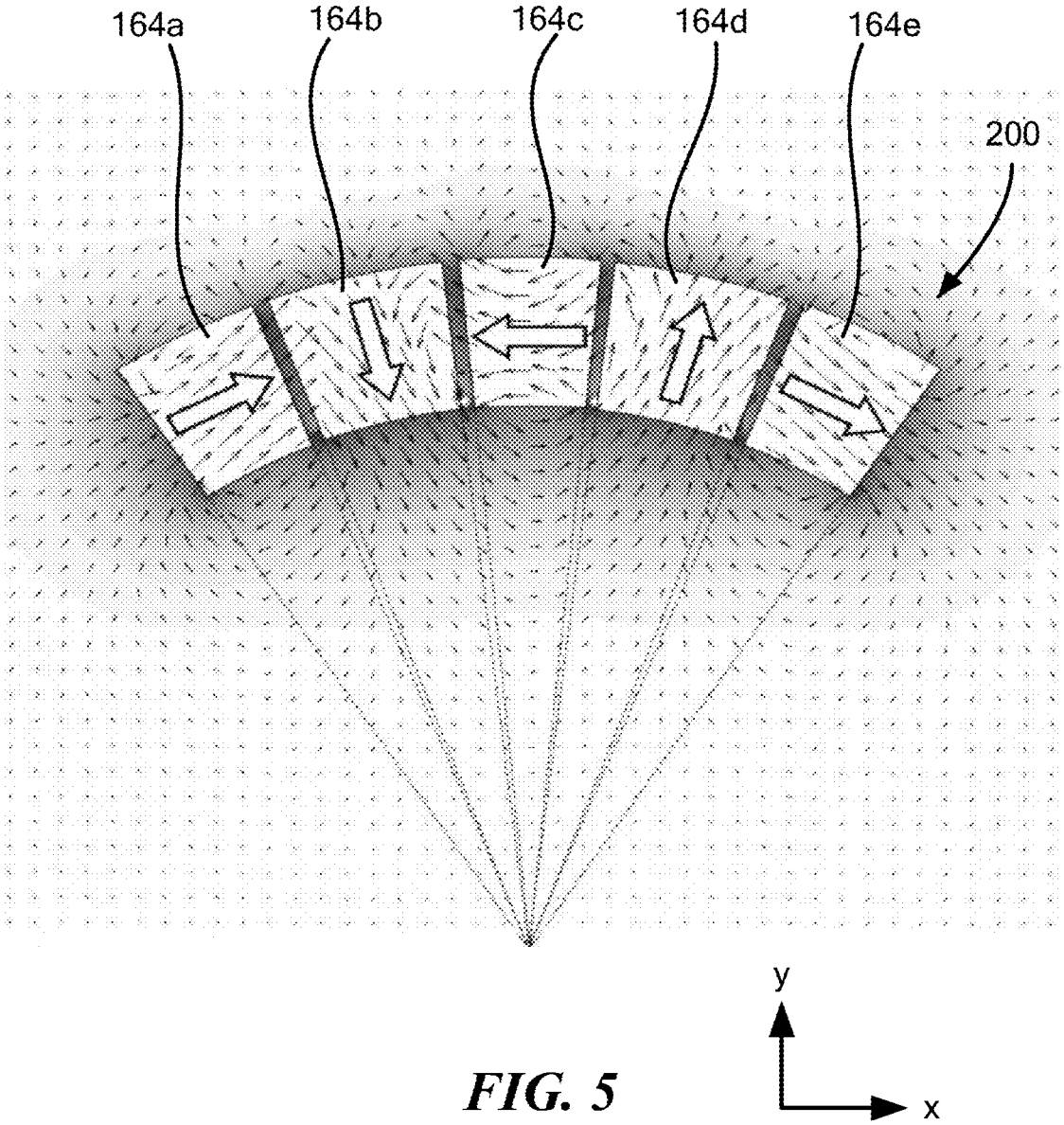
FIG. 5 is an illustration of the magnetic fields generated by the Halbach array of solenoids

Referring to FIG. 5, the diagram 200 depicts the magnetic field intensity and direction generated by the Halbach array scaffold 160, 162 as a result of the ferromagnetic blocks 164*a-e*. Each block can have associated therewith a set of two-dimensional axes illustrating a positive and negative X and y direction. The magnitude and the direction of the arrows indicate the magnitude and direction of the magnetic field respectively. For example, the two outer ferromagnetic blocks 164*a*, 164*e* generate a magnetic field of similar intensity and pointing in the direction of the positive X direction. One ferromagnetic block 164*b* generates a magnetic field pointing in the negative y direction, while ferromagnetic block 164*d* has a magnetic field with a similar intensity to the one produced by ferromagnetic block 168*b* but pointing in the positive y direction. Ferromagnetic block 164*c* generates a magnetic field pointing in the negative X direction. This Halbach array 150 generates magnetic fields in the vicinity of the inner side of the array 150 stronger than that of the outer side. The normal direction of the two side surfaces of the ferromagnetic blocks are orthogonal to the radial direction.

In an alternative embodiment, the architecture may be used to provide a sealing mechanism between the gear sides and the housing 120. The architecture of the Halbach magnet array of solenoids 150*a-b* can also be applied for sealing between the gear sides 250, 255 and the housing (FIG. 6A) when MR fluids are used. As shown in FIG. 6B, volumetric loss also happens at position B-B and C-C, though this leakage is much less significant than the loss between the gear teeth and the housing. Using an approach similar to the ones discussed herein, a magnetic field supplied by the Halbach magnet arrays 150*a-b* to the MR fluid can seal the gear sides 250, 255 to mitigate volumetric loss.

Figure 7A:
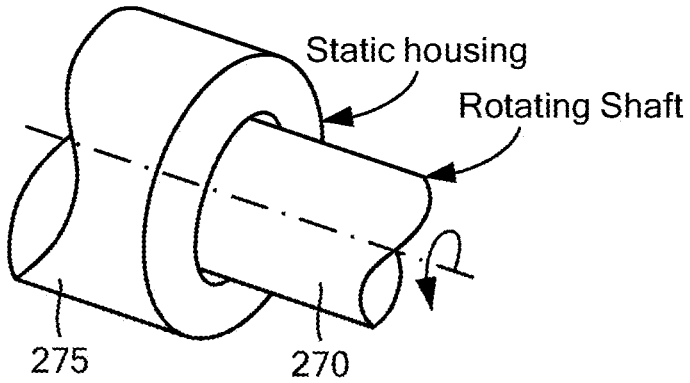
FIG. 7B is a cross-section view of a portion of a rotating shaft and a housing with a conventional sealing mechanism.
FIG. 7C is a cross-section view of a portion of a rotating shaft and housing which may be the same as or similar to the shaft and housing of FIG. 7A and which includes a dynamic sealing mechanism using magnetorheological (MR) fluids.
Figure 7B:
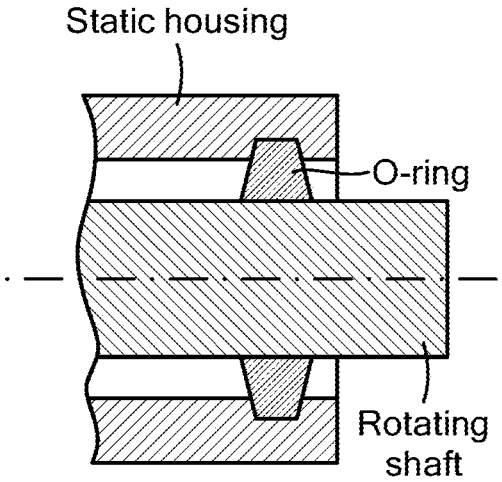
FIG. 7B PRIOR ART

In a further embodiment, additional sealing may be provided between the rotating shaft 270 and the static housing 275 in various types of pumps, e.g., as shown in FIG. 7A. The traditional sealing approach is to apply an oil-resistant O-ring (e.g., as shown in FIG. 7B).

Figure 7C:
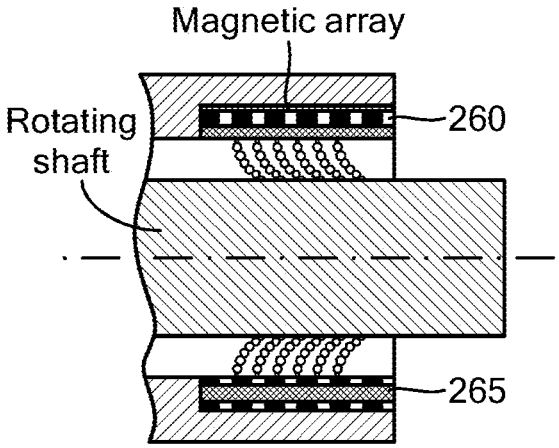

Alternatively, the Halbach magnet array of solenoids may be applied using MR fluid (see, e.g., FIG. 7C). One advantage of this approach is that the magnetic field intensity can be tuned adaptively according to the working condition of the pump. In this embodiment, additional magnetic arrays 260, 265 are incorporated into the static housing to supply a magnetic field to the MR fluid to seal the area between the rotating shaft 270 and the static housing 275.

Example 1

A microfluidic system includes a network of microchannels in fluid communication with each other and having a width of approximately 0.7 mm or 70 micrometers. Flowing through the channels of the microchannel network is a mixture containing a magneto-rheological (MR) fluid that has a volume fraction of MR particles diluted to be 1%. The MR fluid can have a carrier fluid of silicone oil and the MR particles can have a surface field of 1895 Gauss (NdFeB, Grade N42, 2.44 oz.). Within this microfluidic system, Couette flow and Poiseuille flow of the MR fluid are observed as a result of two slots moving in parallel with respect to each other and in the presence of various magnetic field intensities. Within this system, the Reynolds $$\mathrm{Re}_\delta = \frac{pU\delta}{\mu} = 0.05 << 1,$$

number or ratio of viscous forces to inertial forces is less than one (1), thus the inertia of the MR fluid in this example is negligible. Given the low Reynolds number of the system, the conservation of momentum equation for steady, laminar flow, in the x-direction, reduces to:

$$\frac{dp}{dx} = \frac{d\tau_{yx}}{dy},$$

where p is the mechanical pressure, $\tau_{yx}$ is the shear stress. The MR fluid can be modeled as a Bingham fluid, and because of the distribution of the magnetic field intensity, the yield stress is larger in the slot closer to the magnet than that in the further one. The constitutive relationship can be expressed as:

$$\tau_{yx} = \left(\mu + \frac{\tau_y}{|\gamma|}\right)\gamma;\ |\tau| > \tau_y$$

$$\gamma = 0;\ |\tau| \le \tau_y,$$

where μ is the viscosity of the MR fluid, $T_y$ is the yield stress, and y is the shear rate. The following boundary conditions on the inner and outer walls of the channel apply:

$$v_{x|y=0} = U$$

$$v_{x|y=\delta} = 0,$$

where $v_x$ is the velocity of the fluid in x-direction and U is the velocity of the inner wall.

In this Example 1, the behavior of the dipole chains can be defined by two Mason numbers. A first Mason number that is the ratio between the shear forces and the magnetic interaction forces in Poiseuille flow, and a second Mason number one for Couette flow. The magnetic interaction forces are characterized by the yield stress $\tau_y$.

$$Mn(p) = \frac{\delta}{\tau_y}\left(-\frac{dp}{dx}\right)$$

$$Mn(\Omega) = \frac{\tau_y \delta}{\mu R\Omega}$$

Other dimensionless variables are defined as follows:

$$y^* = \frac{y}{\delta};\ \tau^* = \frac{\tau_{yx}}{\tau_y};\ v^* = \frac{v_x}{R\Omega};\ U^* = \frac{R\Omega}{|R\Omega|}.$$

Substituting the dimensionless variables into the conservation of momentum equation and constitutive equation yields:

$$\frac{d_{\tau*}}{d_{\tau*}} + Mn(p) = 0;$$

$$\tau^* = \frac{1}{Mn(\Omega)}\frac{dv*}{dy*} + \mathrm{sgn}\left(\frac{dv*}{dy*}\right);\ |\tau^*| > 1$$

$$\frac{dv*}{dy*} = 0;\ |\tau^*| \le 1.$$

The boundary conditions in this Example 1 become:

$$v^*|_{y^*=0} = U^*;\ v^*|_{y^*=1} = 0.$$

The velocity profiles of various fluid dynamics can be computed from the governing equation and the associated boundary conditions and can be categorized into three modes: (i) a one-region mode, (ii) a two-region mode and (iii) a three-region mode. The one-region mode occurs when the pressure gradient between the inlet and the outlet is small and the velocity of the boundary is relatively large. In this mode, the fluid stress is larger than the yield stress of the Bingham fluid across the system, so chains of MR particles cannot form. The velocity profile in the one-region mode can be identical to that of a Newtonian fluid in Poiseuille Couette flow. The two-region mode occurs as the pressure gradient between the inlet and outlet increases, which in turn causes an increase in the slope of the stress distribution. In the region where the fluid stress is smaller than the yield stress, a plug zone will occur, where MR particle chains form and the velocity profile can resemble plug flow. In two-region mode, the plug zone is anchored to the surface nearest the magnet, whereas in the region at the opposing surface the MR particles are prevented from aggregating, similarly to one-region mode. Finally, the three-region mode occurs as the pressure gradient between the inlet and outlet increases even further. Under such conditions, the plug zone will detach from the wall and move to the middle of the channel, surrounded by Newtonian regions on either side.

The average velocity of the fluid in the one-region mode is given by:

$$\bar{v}^* = \frac{1}{12} Mn\ (\Omega)\ Mn(p) + \frac{1}{2}U^*.$$

The average velocity of the fluid in the two-region mode is given by:

$$\bar{v}^* = \frac{U^*}{3}\sqrt{\frac{-2U^*}{Mn\ (\Omega)\ Mn(p)}}.$$

The average velocity of the fluid in the three-region mode is given by:

$$\bar{v}^* = \frac{1}{12}Mn\ (\Omega)\ Mn(p)\left(1 - \frac{3}{|Mn(p)|} + \frac{4}{|Mn(p)|^3}\right) + \frac{U^*}{2} \pm \frac{1}{Mn\ (\Omega)\ (2 \mp Mn(p))^2}.$$

The transition pressure from one-region mode to two-region mode and from two-region mode to three-region mode can also be computed and are found to be quantities $Mn(p)_{R1}$ and $Mn(p)_{R2}$ respectively:

$$Mn(p)_{R1} = \frac{2}{Mn(\Omega)}$$

$$Mn(p)_{R2} = 2 + \frac{1}{Mn(\Omega)} + \sqrt{\frac{1}{Mn(\Omega)^2} + \frac{4}{Mn(\Omega)}}.$$

In terms of the design and application for external gear pumps, two performance metrics may be considered which evaluate the performance of dynamic seals. The first performance metric is given by the ratio of volumetric flow rate loss to the nominal volumetric flow rate of the gear pump.

Figure 8A:
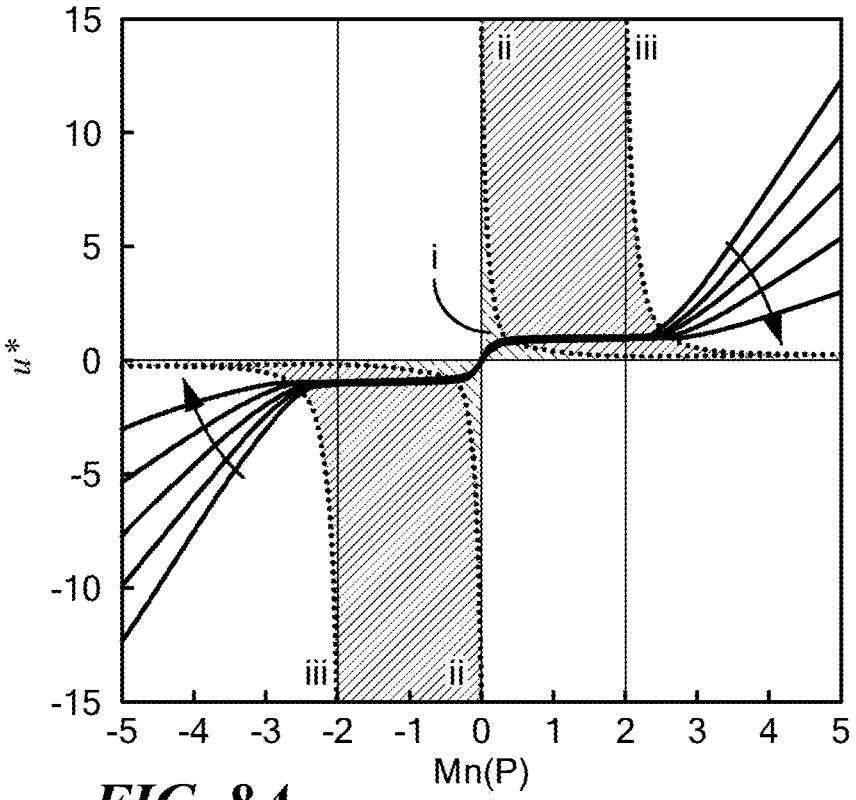
FIG. 8A is a plot of volumetric loss vs. flow rate which illustrates ratio of volumetric loss to the normal flow rate of a gear pump having an MR sealing mechanism.

The nominal volumetric flow rate is proportional to the angular speed of the gear. Therefore, the dimensionless group $$u^* = \frac{v}{R\Omega}$$

can be used to characterize the sealing effectiveness of MR fluid, where v is the average velocity of the back-flow rate in the clearance of the gear pump, RΩ is proportional to the volumetric flow rate pumped by the gear pump. FIG. 8A depicts a graphical depiction illustrating ratio of volumetric loss to the normal flow rate of a gear pump. As shown in FIG. 8A, the ratio of volumetric loss to the nominal flow rate of a gear pump is a function of Mn(p), for Mn(Ω) equal 0.5, 1, 1.5, 2, 2.5. The arrow indicates the direction Mn(Ω) increases.

As shown in FIG. 8A, to achieve higher effectiveness, u* should be designed to be as small as possible. $Mn(p)_{R1}$ is the transition point of the velocity profile from one-region mode to two-region mode for both slots, because $Mn(p)_{RS1}$ equals $Mn(p)_{RL1}$. $Mn(p)_{SR2}$, $Mn(p)_{LR2}$ are the transition points of the velocity profile from two-region mode to three-region mode for the slots in the presence of larger and smaller magnetic field intensity respectively. When Mn(p) is larger than $Mn(p)_{SR2}$, u* dramatically increases. Thus, to ensure a small volumetric loss, Mn(p) should be smaller than $Mn(p)_{SR2}$. The second performance metric comes from the energy loss in both of the slots, which can be characterized by the friction factor $$f = \frac{p}{\frac{1}{2}\rho v^2}.$$

Figure 8B:
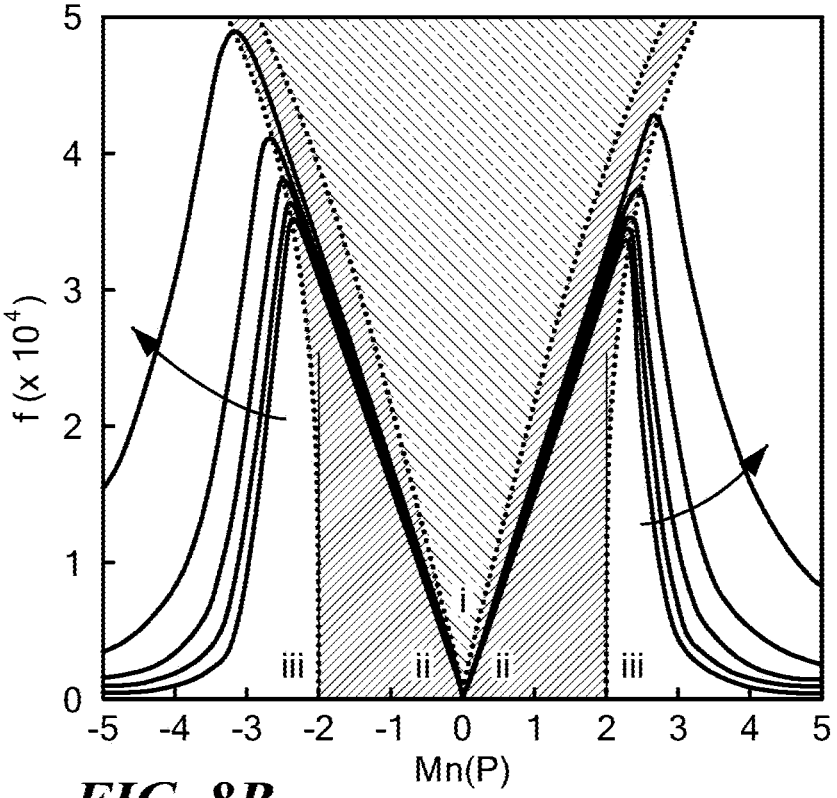
FIG. 8B is a plot friction factor vs. flow rate which illustrates a friction factor.

To achieve the optimal sealing performance, the friction factor is maximized, indicating that the back-flow between the gear teeth 124 and the housing 120 will experience as much energy loss as possible. As shown in FIG. 8B, a friction factor is a function of Mn(p), for Mn(Ω) equal 0.5, 1, 1.5, 2, 2.5. The arrow indicates the direction Mn(Ω) increases. i: one-region mode; ii: two-region mode; iii: three-region mode. The dot lines indicate the transition for the velocity profile to transit from one mode to another. Further, as shown in FIG. 8B, the maximum friction factor can be achieved around $Mn(p)_{SR2}$, which is the Mn(p) of the transition point from two-region mode to three-region mode for the slot in presence of the smaller magnetic field intensity.

Upon considering the two performance metrics mentioned above, the optimal sealing performance can be achieved at the transition of two-region mode to three-region mode. Thus, at any given nominal work condition of external gear pump, the magnetic field intensity can be tuned to make the yield stress satisfy the equation described above, namely:

$$Mn(p)_{R1} = \frac{2}{Mn(\Omega)}$$

$$Mn(p)_{R2} = 2 + \frac{1}{Mn(\Omega)} + \sqrt{\frac{1}{Mn(\Omega)^2} + \frac{4}{Mn(\Omega)}}.$$

This equation reflects the condition for the MR fluid to transit from the two-region mode to the three-region mode, and can be expressed explicitly by the following equation:

$$\tau_y = \frac{1}{2}\frac{\left(\frac{dp}{dx}\delta\right)^2 - 2\mu\frac{dp}{dx}R\Omega}{\frac{dp}{dx}\delta - \sqrt{2\mu\frac{dp}{dx}R\Omega}}.$$

The relationship between magnetic field intensity (B) and yield stress (Pa) of MR fluid is expressed as:

$$\lg B = \frac{4}{7}\lg\tau_y + \frac{4}{7}\lg(9 \times 10^{-4}),$$

where B is the magnetic field intensity, $\tau_y$ is the yield stress. A ratio Φ is defined as a metric for the effectiveness of dynamic seals using MR fluid:

$$\Phi = \frac{Q_{Oil} - Q_{MR}}{Q_{Oil}},$$

where $Q_{Oil}$ is the volumetric loss using general pump oil, $Q_{MR}$ is the volumetric loss using MR fluid with the same viscosity as the general pump oil.

Figure 9:
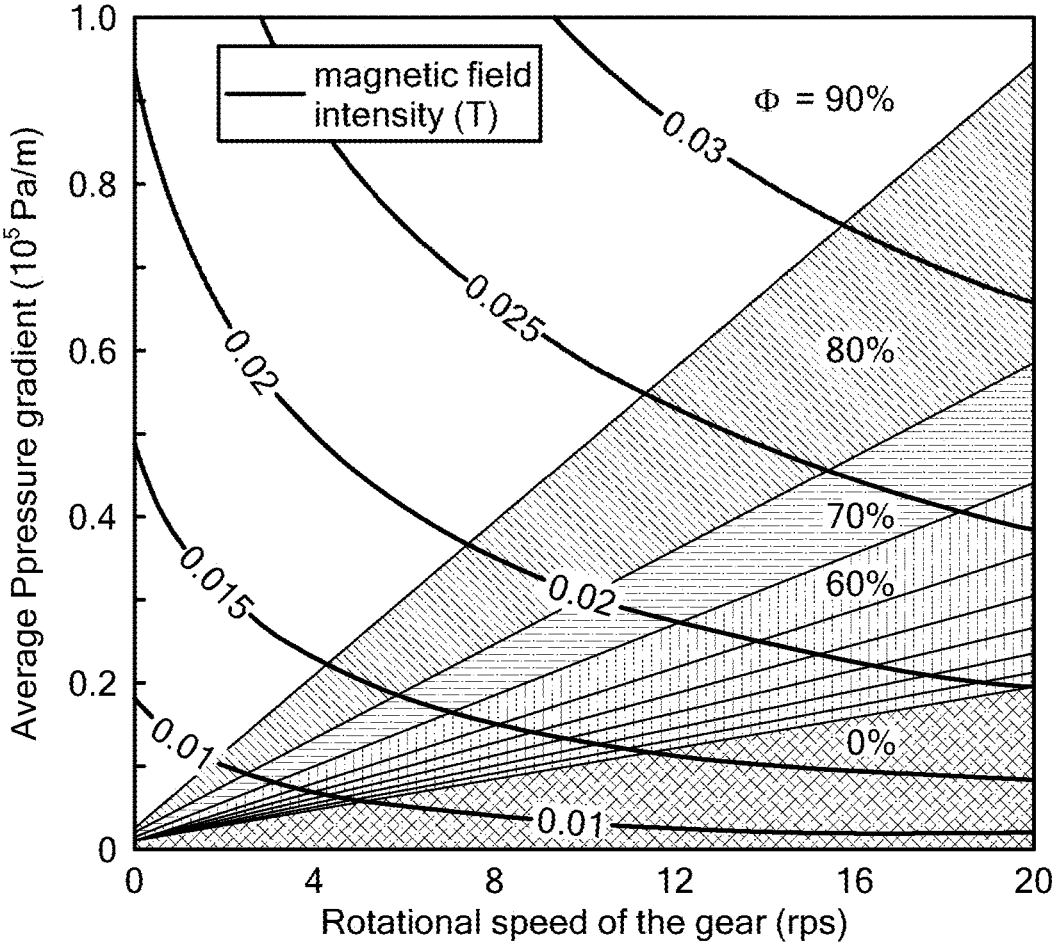
FIG. 9 is a plot of average pressure gradient vs. rotational speed of a gear which illustrates efficiencies for a variety of different magnetic field intensities.

The optimal magnetic field intensity (T) is shown in FIG. 9. The solid line indicates the magnetic field intensity distribution from 0.01 T to 0.03 T at given specific condition. The shaded area indicates the percentage of the reduction in volumetric loss from Φ=90% (white) to 0% (black). This indicates that dynamic sealing using rheological fluid will achieve the optimal sealing effectiveness under a high pressure gradient between the inlet and the outlet and relatively low rotational speed, which would reduce the volumetric loss to over 90%.

As indicated above, volumetric loss accounts for the extremely low efficiency of small-scale gear pumps. In order to reduce the volumetric loss without introducing larger friction, tighter manufacturing tolerances, or vulnerability to vibrations, the above-described techniques provide for activation of magnetorheological fluid in the vicinity of the clearance between gear and housing to create a dynamic seal.

For purposes of illustrating the present embodiment, the disclosed embodiments are described as embodied in a specific configuration and using special logical arrangements, but one skilled in the art will appreciate that the device is not limited to the specific configuration but rather only by the claims included with this specification. In addition, it is expected that during the life of a patent maturing from this application, many relevant technologies will be developed, and the scopes of the corresponding terms are intended to include all such new technologies a priori.

What is claimed is:

1. A micro-fluidic pumping system comprising:

a gear housing having an inlet and an outlet, wherein a drive gear, an idler gear and a drive shaft are disposed within the gear housing;

a magneto-rheological (MR) fluid disposed in the housing;

a front end plate coupled to a first surface of the gear housing;

a rear end plate coupled to a second, different surface of the gear housing; and first and second Halbach magnet arrays coupled to the gear housing and disposed between the front end plate and the rear end plate, wherein the first and second Halbach magnet arrays include one or more solenoids and the first Halbach magnet array is disposed proximate to the drive gear and the second Halbach magnet array is disposed proximate to the idler gear.

2. The system of claim 1, wherein the gear housing is disposed between the front end plate and the rear end plate.

3. The systems of claim 1, wherein the first Halbach magnet array is disposed on an upper surface of the gear housing and the second Halbach magnet array is disposed on a lower surface of the gear housing.

4. The system of claim 3, wherein the upper surface and the lower surface of the gear housing have an arc shape.

5. The system of claim 1, wherein a clearance between the drive gear and the idler gear forms a channel coupling the inlet to the outlet.

6. The system of claim 5, wherein a flowrate of the magneto-rheological (MR) fluid through the channel corresponds to dimensions of at least one of or a combination of: the gear housing, the drive gear, the idler gear, a rotational speed of the drive gear, a rotational speed of the idler gear, or a magnetic field intensity of the first and second Halbach magnet arrays.

7. The system of claim 5, wherein a back flow rate of the channel corresponds to dimensions of at least one of or a combination of: the gear housing, the drive gear, the idler gear, a rotational speed of the drive gear, a rotational speed of the idler gear, or a magnetic field intensity of the first and second Halbach magnet arrays.

8. The system of claim 1, wherein the gear housing, the front end plate and the rear end plate include non-ferromagnetic material.

9. The system of claim 1, wherein the first and second Halbach magnet arrays comprise a top Halbach array scaffold, a bottom Halbach array scaffold, five ferromagnetic blocks, a plurality of wires and two independent resonant-power-transfer supplies.

10. The system of claim 9, wherein each of the five ferromagnetic blocks have a ring shape with a rectangular cross-section with a direction of one or more sides orthogonal to a radial direction.

11. The system of claim 9, wherein each of the five ferromagnetic blocks have a counter-bored hole.

12. The system of claim 9, wherein each of the five ferromagnetic blocks include ferromagnetic material.

13. The system of claim 9, wherein the top Halbach array scaffold has threaded holes and through-holes.

14. The system of claim 9, wherein the plurality of wires are routed on the five ferromagnetic blocks and the bottom Halbach scaffold.

15. A micro-fluidic pumping system comprising:

means for housing a drive gear, an idler gear and a drive shaft;

means for providing a container for a magneto rheological (MR) fluid, the container having an inlet and an outlet;

a means for coupling a front end plate to a first surface of the gear housing;

a means for coupling a rear end plate to a second, different surface of the gear housing; and a means for coupling a first and second Halbach magnet arrays to the gear housing, wherein the first Halbach magnet array is disposed proximate to the drive gear and the second Halbach magnet array is disposed proximate to the idler gear.

16. The system of claim 15, further comprising a means for preventing backflow.

17. The system of claim 15, further comprising a means for coupling the inlet to the outlet.

18. The system of claim 17, wherein a fluid dynamic of the magneto-rheological (MR) fluid through the inlet or outlet corresponds to at least one of or a combination of a pressure applied to the MR fluid through the inlet, a flow velocity of the MR fluid, a rotational speed of the drive gear, a rotational speed of the idler gear, or a magnetic field intensity of at least one of the first and second Halbach magnet arrays.

19. A micro-fluidic pumping system comprising:

a gear housing having an inlet and an outlet, wherein a drive gear, an idler gear and a drive shaft are disposed within the gear housing;

a magneto-rheological (MR) fluid disposed in the housing;

a front end plate coupled to a first surface of the gear housing;

a rear end plate coupled to a second, different surface of the gear housing; and first and second Halbach magnet arrays coupled to the gear housing and disposed between the front end plate and the rear end plate, wherein the first and second Halbach magnet arrays include one or more solenoids and the first Halbach magnet array is disposed proximate to the drive gear and the second Halbach magnet array is disposed proximate to the idler gear, wherein the first and second Halbach magnet arrays generate a magnetic field causing the MR fluid to create dipoles within a gap between the gear housing and one of the drive gear and the idler gear.

20. The micro-fluidic pumping system of claim 19, wherein the magnetic field causes the MR fluid to create dipoles within a gap between the gear housing and the drive gear, and a second gap between the gear housing and the idler gear.

21. The micro-fluidic pumping system of claim 19, wherein the magnetic field causes the MR fluid to create dipoles within a gap between the gear housing and the front end plate.

* * * * *